US011644233B2

(12) United States Patent
Ji et al.

(10) Patent No.: US 11,644,233 B2
(45) Date of Patent: May 9, 2023

(54) REFRIGERATOR SUPPORTING ROD FOR INSTALLING LIGHTING DEVICE

(71) Applicants: Self Electronics Co., Ltd., Zhejiang (CN); Wanjiong Lin, Zhejiang (CN); Self Electronics USA Corporation, Norcross, GA (US)

(72) Inventors: Feng Ji, Zhejiang (CN); Zhaoyong Zheng, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 17/664,529

(22) Filed: May 23, 2022

(65) Prior Publication Data

US 2022/0373250 A1 Nov. 24, 2022

(30) Foreign Application Priority Data

May 24, 2021 (CN) ..... CN202110568014

(51) Int. Cl.
*F25D 27/00* (2006.01)
*F21S 4/28* (2016.01)

(52) U.S. Cl.
CPC ..... *F25D 27/00* (2013.01); *F21S 4/28* (2016.01); *F25D 2201/12* (2013.01); *F25D 2400/02* (2013.01)

(58) Field of Classification Search
CPC ..... F21S 4/28; F25D 27/00; F25D 2201/12; F25D 2400/02
See application file for complete search history.

(56) References Cited

U.S. PATENT DOCUMENTS 5,645,330 A * 7/1997 Artwohl ..... F25D 27/00 49/504
6,578,978 B1 * 6/2003 Upton ..... F25D 27/00 362/125
11,143,388 B2 * 10/2021 Ji ..... F21V 19/0035
2009/0161350 A1 * 6/2009 Sommers ..... A47F 3/001 362/373
2011/0083460 A1 * 4/2011 Thomas ..... F21S 4/28 62/264
2011/0286207 A1 * 11/2011 Chan ..... F21V 15/013 362/217.1
2011/0304253 A1 * 12/2011 Howington ..... F25D 27/00 312/405
2013/0285517 A1 * 10/2013 Wach ..... A47F 3/043 49/504
2013/0301256 A1 * 11/2013 Thomas ..... A47F 3/001 362/224
2021/0180859 A1 * 6/2021 Ji ..... A47F 3/001

* cited by examiner

*Primary Examiner* — Oluseye Iwarere
*Assistant Examiner* — Michael Chiang
(74) *Attorney, Agent, or Firm* — Wang Law Firm, Inc.

(57) ABSTRACT

A refrigerator supporting rod for installing lighting device has a rod body, the rod body having an inner side surface facing toward the refrigerator and an outer side surface back toward the refrigerator, a heat insulating layer is provided between the inner side surface and the outer side surface, the inner side surface is provided with a lamp mounting groove extending in the longitudinal direction. According to the refrigerator supporting rod for installing lighting device, a lamp can be installed in an embedded mode to integrate the two, so that the probability of touching the lamp is reduced, and the likelihood of damage is reduced.

9 Claims, 4 Drawing Sheets

REFRIGERATOR SUPPORTING ROD FOR INSTALLING LIGHTING DEVICE

RELATED APPLICATION

This application claims priority to Chinese Patent Application No. CN 202110568014.3, filed on May 24, 2021, the entire specification of which is incorporated herein by reference.

FIELD OF THE TECHNOLOGY

The present invention relates to a freezer and refrigerator illumination, particularly a refrigerator supporting rod for installing lighting device.

BACKGROUND

For a freezer with a transparent exhibition door made from a transparent plate, a lighting device is generally installed inside and on a supporting rod attached to the frame of the freezer for illumination.

At present, the lamp for freezer lighting is usually mounted on the inner surface of the supporting rod, which is prone to collision during use, thus damaging the lamp.

BRIEF SUMMARY OF THE INVENTION

In view of this, the present invention provides a refrigerator supporting rod for installing lighting device to solve the above technical problems.

A refrigerator supporting rod for installing lighting device includes a rod body, and the rod body includes a inner side surface facing toward the refrigerator and a outer side surface back toward the refrigerator, a heat insulating layer is provided between the inner side surface and the outer side surface, the inner side surface is provided with a lamp mounting groove extending in the longitudinal direction.

Both sides of the top surface of the lamp mounting groove are reflective surfaces.

The reflective surface is white.

The rod body is manufactured by extrusion, and the reflective surface is manufactured by two-color extrusion.

The lamp mounting groove is provided with at least two intervals distributed lamp buckles.

The outer side surface is provided with a heating module extending in the longitudinal direction.

The heating module comprises a thermal wire installed in the longitudinal direction and a heat conductive plate connected to the outer side surface.

The heat conductive plate is a U profile, and ends of the two sides of the U profile is bent inward, and the outer side surface is provided with two strip groove supporting both sides of the U profile.

The rod body is a hollow structure, the heat insulating layer is made of heat insulating material filled in the hollow structure.

The insulating material is polyurethane.

The technical effects of the present invention:

The present invention is used to mount the refrigerator supporting rod for mounting the lighting device, which can be embedded in the lamp, so that the two are integrated, reducing the charging time of the lamp, reducing damage, and a reflective surface is provided in the cold cabinet support rod, which can better utilize the stray light of the lamp, improve efficiency and the lighting effect, and improve anti-glare effects.

BRIEF DESCRIPTION OF THE DRAWINGS

Embodiments of the present invention will be described below with reference to the drawings, in which.

DETAILED DESCRIPTION OF THE INVENTION

Specific embodiments of the present invention will be described in further detail below based on the drawings. It should be understood that the description of the embodiments of the present invention herein is not intended to limit the protection scope of the present invention.

Figure 1:
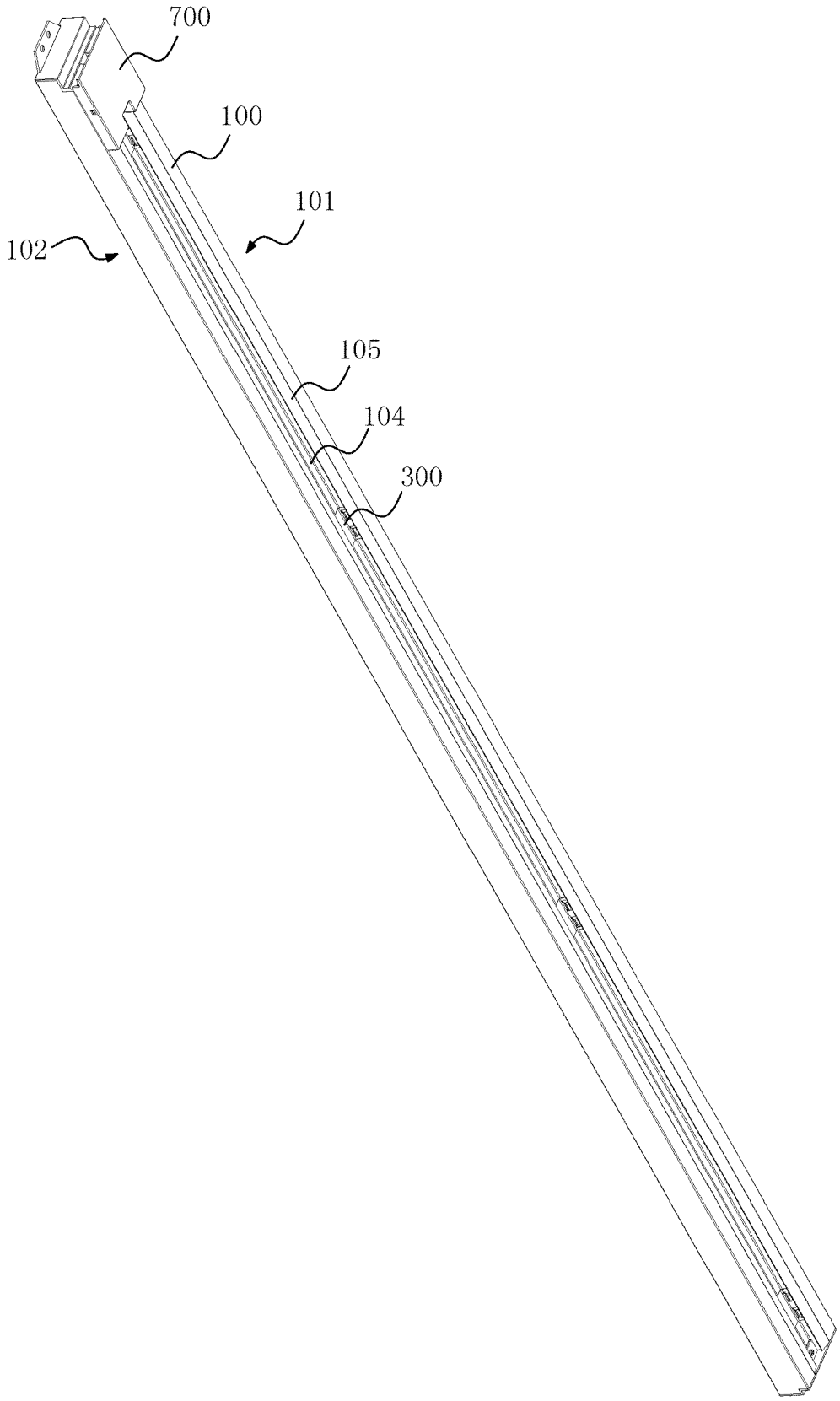
FIG. 1 is a structural diagram of the refrigerator support rod (without the lamp) for mounting the lighting device of the present embodiment.
Figure 2:
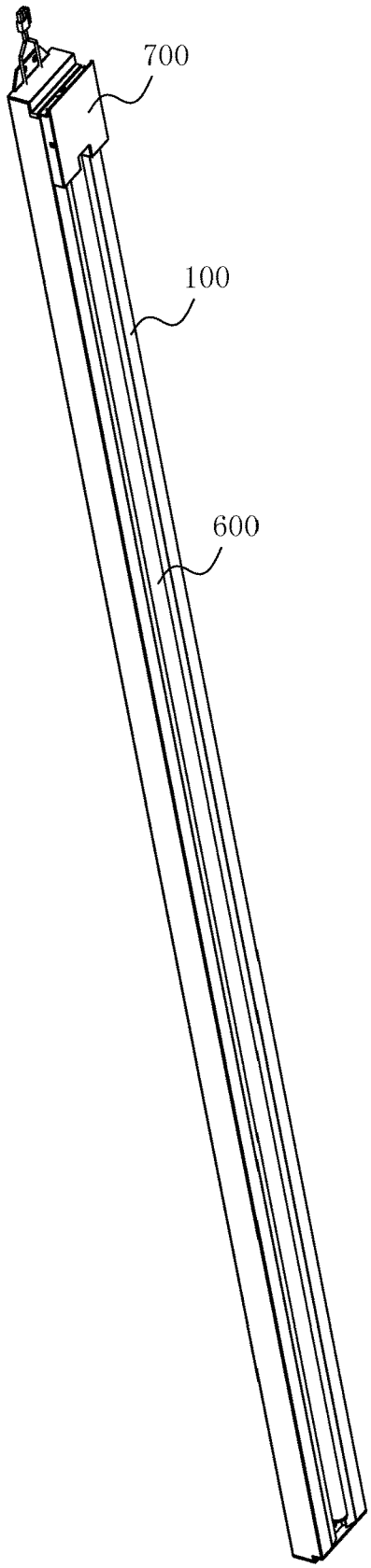
FIG. 2 is a structural diagram of the refrigerator support rod (with lamp) for mounting the lighting device of the present embodiment.
Figure 3:
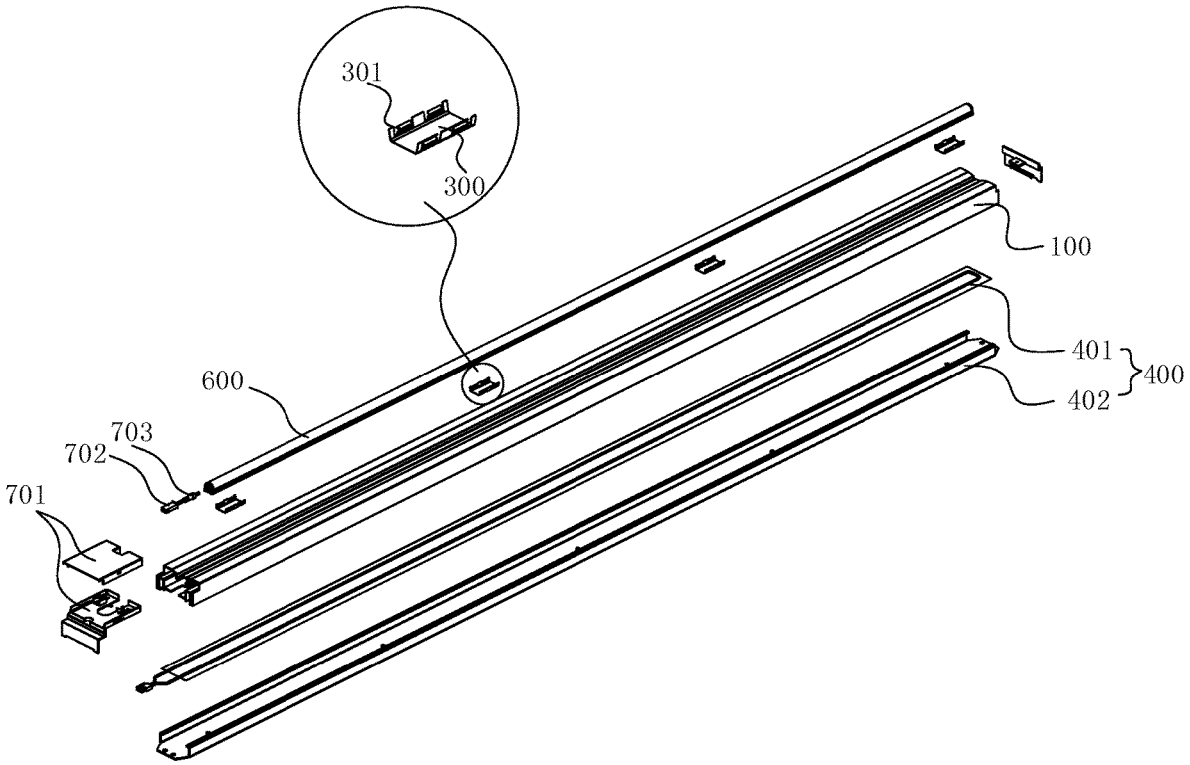
FIG. 3 is an explosion diagram of the refrigerator support rod (with lamp) for mounting the lighting device of the present embodiment.
Figure 4:
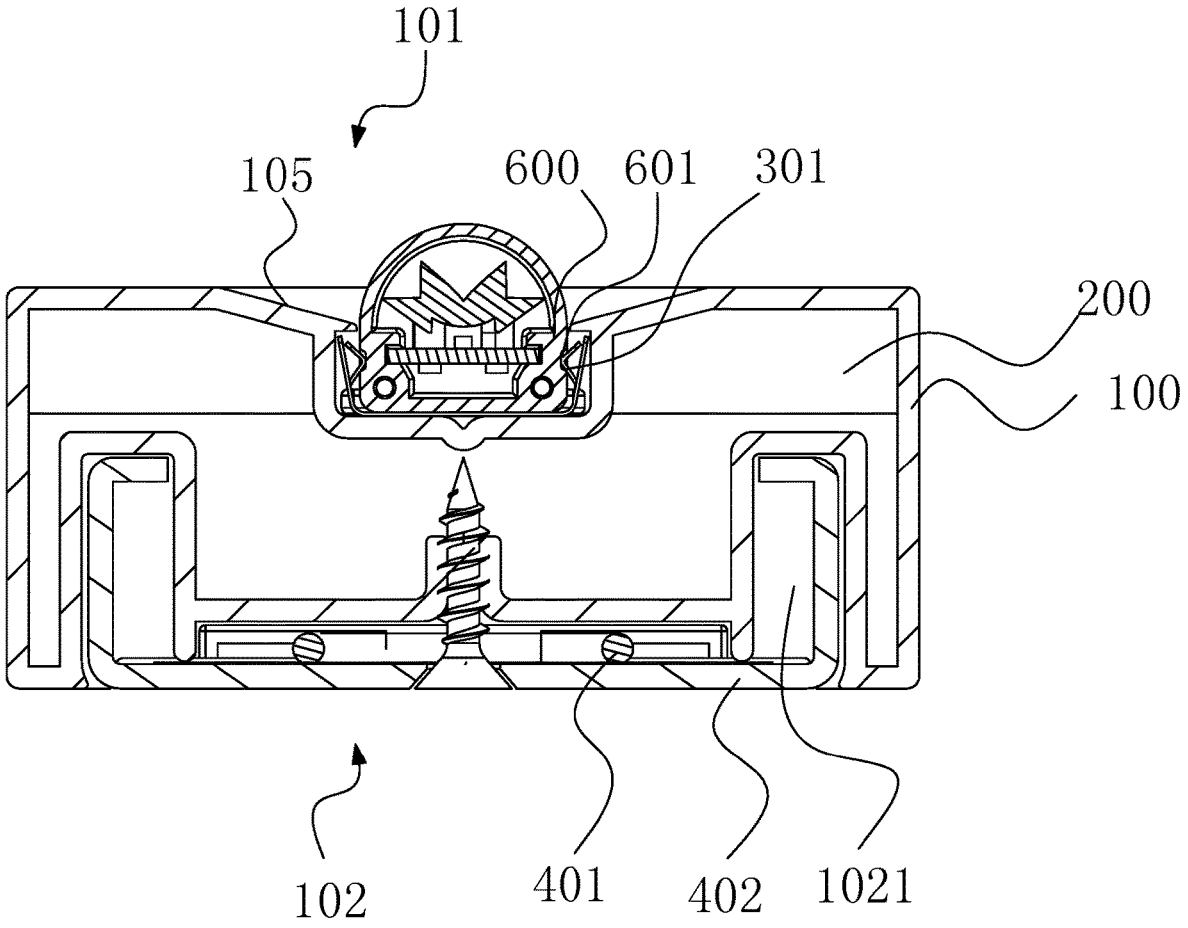
FIG. 4 is a cross-sectional view of the refrigerator support rod (with lamp) for mounting the lighting device of the present embodiment.

As shown in FIGS. 1-4, the refrigerator supporting rod for installing lighting device includes a rod body 100, and the rod body 100 includes an inner side surface 101 facing toward the refrigerator and an outer side surface 102 back toward the refrigerator, a heat insulating layer 200 is provided between the inner side surface 101 and the outer side surface 102, and the inner side surface 101 is provided with a lamp mounting groove 104 extending in the longitudinal direction.

When the refrigerator is mounted, the inner side surface 101 of the refrigerator support rod in the present embodiment faces the inside of the refrigerator, and the outer side surface 102 faces the outside of the refrigerator, and the refrigerator supporting rod can be vertically disposed, or be arranged laterally. The inner side surface 101 of the refrigerator supporting rod in the present embodiment is equipped with a lamp.

The lamp mounting groove 104 can be used for recessed installation of a lamp for refrigerator illumination, reducing the contact with the lamp, reducing damage.

In order to facilitate the connection to the external power source, one end of the rod body 100 is provided with a wiring module 700, including an end cap 701, an external plug 702 disposed in the end cap 701 and a plug 703 connected with to the external plug 702 and being electrically connected to the lamp.

In order to improve the efficiency, the effect of preventing glare, in this embodiment, both sides of the top surface of the lamp mounting groove 104 are reflective surfaces 105 that expand outwardly. Outer expansion means that the diameter is gradually increased, and can be a flat surface or a curved surface. In this embodiment, the reflective surface 105 is a straight inclined surface. Further, the reflective surface 105 is white. In this embodiment, the rod body 100 generally uses a plastic having certain strength, manufactured by extrusion, so the reflective surface 105 is a better choice for white plastic, facilitating material and manufacturing. Further, the rod body 100 is manufactured by extrusion, and the reflective surface 105 is manufactured by two-color extrusion. The arrangement of the reflective surface 105 can not only utilize the pneumatic light of the lamp, but also improve the light efficiency and the lighting effect, and the applicable lamps of the present invention are large angular light, which has the effect of sweeping. It will produce glare in a wide range, and the setting of the reflective surface 105 can reduce glare. Further, the reflector surface 105 is set symmetrically. The included angle between the reflector surface 105 and the depth direction of the lamp mounting groove 104 is 75°, but can be selected in the range of 60° to 85°. The reflective surfaces have an eave extending over the mounting groove.

In order to facilitate mounting and disassembly, in this embodiment, the lamp mounting groove 104 is provided with at least two intervals distributed lamp buckle 300. The lamp buckle 300 is a curved U-shaped spring and has a main surface and two side surfaces. The lower edge of the reflective surface 105 extends to form a card edge, and both side surfaces of the lamp buckle 300 abuts the card edge to achieve a fixation, and each side surface of the U-shaped spring is provided with two clamping parts 301 that protrude toward the opposing side surface. The side surfaces abut against the eaves on the reflective surfaces and the clamping parts cooperate with the card slot 601 of the lamp 600 to achieve fixing.

This embodiment is used to fit with the opening and closing refrigerator door, the outer side surface 102 is provided with a heating module 400 extending in the longitudinal direction. The outer side surface 102 is fitted with the gate, and the heating module 400 operates to prevent water mist on the door. Further, the heating module 400 includes a thermal wire 401 that is laid in the longitudinal direction and a heat conductive plate 402 connected to the outer side surface 102. The heat conductive plate 402 uses a ferroelectric material and can play the role of support. In order to increase the intensity of the heat conductive plate 402, the heat conductive plate 402 is a U-profile, and the end of the two sides of the U-profile is bent inward, and the outer side surface 102 is provided with two strip grooves 1021 supporting two sides of the U-profile.

In order to increase the heat insulating effect, the rod body 100 is a hollow structure, and the heat insulating layer 200 is made of heat insulating material filled in the hollow structure. Further preferred, the heat insulating material is polyurethane, the price is inexpensive, and the material is easy to obtain. With the arrangement of the strip groove 1021 and the lamp mounting groove 104, the rod body 100 has a lot of concave structures, so that the internal volume is small, thereby reducing the use of the heat insulating material, reducing manufacturing cost.

The above are only preferred embodiments of the present invention, and are not used to limit the protection scope of the present invention. Any modification, equivalent replacement or improvement within the spirit of the present invention is covered by the scope of the claims of the present invention.

What is claimed is:

1. A refrigerator supporting rod for installing lighting device, comprising:

a rod body (100) with an inner side surface (101) facing toward the refrigerator and an outer side surface backing toward the refrigerator;

a heat insulating layer (200) is provided between the inner side surface (101) and the outer side surface (102), characterized in that, the inner side surface (101) is provided with a lamp mounting groove (104) extending in a longitudinal direction;

at least one reflective surface attached to the lamp mounting groove and the at least one reflective surface having an eave extending over the lamp mounting groove; and at least one lamp buckle placed in the lamp mounting groove, the at least one lamp buckle having a main surface with two side surfaces, each side surface having at least one clamping part that protrudes toward the opposing side surface, the side surface abuts against the eave of the at least one reflective surface.

2. The refrigerator supporting rod for installing lighting device as claimed in claim 1, wherein the reflective surfaces (105) are white.

3. The refrigerator supporting rod for installing lighting device as claimed in claim 2, wherein the rod body (100) is manufactured by extrusion, and the reflective surface (105) is manufactured by two-color extrusion.

4. The refrigerator supporting rod for installing lighting device as claimed in claim 1, wherein the lamp mounting groove (104) is provided with two lamp buckles (300) and each lamp buckle has two clamping parts.

5. The refrigerator supporting rod for installing lighting device as claimed in claim 1, wherein the outer side surface (102) is provided with a heating module (400) extending in the longitudinal direction.

6. The refrigerator supporting rod for installing lighting device as claimed in claim 5, wherein the heating module (400) comprises a thermal wire (401) installed in the longitudinal direction and a heat conductive plate (402) connected to the outer side surface (102).

7. The refrigerator supporting rod for installing lighting device as claimed in claim 6, wherein the heat conductive plate (402) is a U profile, and ends of the two sides of the U profile is bent inward, and the outer side surface (102) is provided with two strip groove (1021) supporting both sides of the U profile.

8. The refrigerator supporting rod for installing lighting device as claimed in claim 1, wherein the rod body (100) is a hollow structure, the heat insulating layer (200) is made of heat insulating material filled in the hollow structure.

9. The refrigerator supporting rod for installing lighting device as claimed in claim 8, wherein the insulating material is polyurethane.

* * * * *